US008147616B2

(12) United States Patent
Wu et al.

(10) Patent No.: US 8,147,616 B2
(45) Date of Patent: Apr. 3, 2012

(54) CONTAINER RINSING SYSTEM AND METHOD

(75) Inventors: Rei-Young Amos Wu, Palatine, IL (US); Michael J. Mastio, Crystal Lake, IL (US)

(73) Assignee: Stokely-Van Camp, Inc., Chicago, IL (US)

( * ) Notice: Subject to any disclaimer, the term of this patent is extended or adjusted under 35 U.S.C. 154(b) by 281 days.

(21) Appl. No.: 12/255,153

(22) Filed: Oct. 21, 2008

(65) Prior Publication Data

US 2009/0101178 A1 Apr. 23, 2009

Related U.S. Application Data

(60) Provisional application No. 60/981,571, filed on Oct. 22, 2007.

(51) Int. Cl.
*B08B 7/00* (2006.01)
*B08B 7/04* (2006.01)

(52) U.S. Cl. ..... 134/22.18; 134/22.1; 134/23; 134/21; 15/304; 15/306.1

(58) Field of Classification Search ..... 134/22.1, 134/22.18, 23, 24, 25.1, 25.4, 30, 32, 33, 134/34, 37, 21; 15/300.1, 304, 345, 306.1
See application file for complete search history.

(56) References Cited

U.S. PATENT DOCUMENTS

| | | | |
|---|---|---|---|
| 2,199,459 | A | 5/1940 | Herold |
| 2,610,894 | A | 9/1952 | Hall |
| 2,614,680 | A | 10/1952 | Eisenberg |
| 2,784,120 | A | 3/1957 | Hagedorn |
| 2,980,938 | A | 4/1961 | Whelan |
| 3,058,276 | A | 10/1962 | Palma |
| 3,071,497 | A | 1/1963 | Hinson |
| 3,428,257 | A | 2/1969 | Kentfield |
| 3,458,137 | A | 7/1969 | Hans |
| 3,677,273 | A | 7/1972 | Mahlstede |
| 3,801,020 | A | 4/1974 | Mocarski |
| 3,955,588 | A | 5/1976 | Born |
| 4,017,330 | A | 4/1977 | Aidlin |
| 4,097,000 | A | 6/1978 | Derr |
| 4,104,081 | A | 8/1978 | Totten |

(Continued)

FOREIGN PATENT DOCUMENTS

JP 2002255123 A * 9/2002

(Continued)

OTHER PUBLICATIONS

Bertrand P.E. Danoa, James A. Liburdya, and Koonlaya Kanokjaruvijitb, "Flow Characteristics and Heat Transfer Performances of a Semi-Confined Impinging Array of Jets: Effect of Nozzle Geometry," Department of Mechanical Engineering, Oregon State University, Sep. 2003.

(Continued)

*Primary Examiner* — Alexander Markoff
(74) *Attorney, Agent, or Firm* — Banner & Witcoff, Ltd.

(57) ABSTRACT

A container rinsing system (10) has an air nozzle adapted to be positioned proximate an opening of the container and adapted to direct a supply of compressed air to the container. A vacuum member is adapted to be in communication with a vacuum source. The vacuum member is positioned around the air nozzle and adapted to vacuum foreign particles away from the container.

24 Claims, 6 Drawing Sheets

U.S. PATENT DOCUMENTS 4,180,105 A 12/1979 Harvey
4,207,286 A 6/1980 Gut Boucher
4,208,761 A 6/1980 Ionescu
4,313,767 A 2/1982 Bemis
4,385,728 A 5/1983 Inglis
4,459,483 A 7/1984 Oikari
4,483,435 A 11/1984 Ionescu
4,635,662 A 1/1987 Totten
4,667,690 A 5/1987 Hartnig
4,727,614 A 3/1988 Swistun
4,883,542 A 11/1989 Voneiff
4,982,768 A 1/1991 Ahlers
4,987,630 A 1/1991 Allen
5,076,303 A * 12/1991 McBrady et al. ..... 134/21
5,129,212 A 7/1992 Duffey
5,145,297 A 9/1992 McGrath
5,159,960 A 11/1992 Pringle
5,265,298 A * 11/1993 Young ..... 15/1.51
5,279,017 A * 1/1994 Foreshew ..... 15/304
5,295,523 A 3/1994 Gentile
5,325,020 A 6/1994 Campbell
5,351,354 A 10/1994 Hasumi
5,363,866 A 11/1994 Egger
5,464,483 A 11/1995 Avelis
5,487,200 A * 1/1996 Herzog ..... 15/1.51
5,546,631 A 8/1996 Chambon
5,598,316 A 1/1997 Kasting
5,700,327 A 12/1997 Babacz
5,862,840 A 1/1999 Hansen
5,881,429 A * 3/1999 Drewitz ..... 15/304
5,896,899 A 4/1999 Schmitz
5,911,249 A 6/1999 Sanfilippo
5,942,045 A 8/1999 Raghavan
6,026,867 A 2/2000 Klarl
6,065,683 A 5/2000 Akin
6,173,827 B1 1/2001 Carey
6,189,292 B1 2/2001 Odell
6,209,705 B1 4/2001 Drewitz
6,332,484 B1 12/2001 Stahlecker
6,334,472 B1 1/2002 Lemke
6,431,227 B1 8/2002 Ter Haar
6,457,497 B1 * 10/2002 Adriansens et al. ..... 141/91
6,627,163 B1 9/2003 Awakowicz
6,670,607 B2 12/2003 Wood
6,691,747 B1 2/2004 Marcus
6,752,959 B2 6/2004 Smith
6,761,191 B2 7/2004 Rosen
6,786,249 B2 9/2004 Armbruster
7,243,865 B2 7/2007 Jarchaw
7,360,724 B2 4/2008 Willey
7,487,568 B2 * 2/2009 Cirette et al. ..... 15/304
7,621,301 B2 11/2009 Wu
2002/0014276 A1 2/2002 Clusserath
2003/0115710 A1 6/2003 Choi
2003/0198570 A1 10/2003 Asahara
2006/0117708 A1 6/2006 Thielmann
2007/0240784 A1 * 10/2007 Wu et al. ..... 141/89
2009/0101178 A1 4/2009 Wu
2009/0158537 A1 6/2009 Shijima
2009/0266923 A1 10/2009 Gardner
2010/0072311 A1 3/2010 Tanaka
2010/0088830 A1 4/2010 Takayanagi
2010/0163653 A1 7/2010 Pucciani
2010/0200020 A1 8/2010 Gmeiner
2010/0327077 A1 12/2010 Parsheh
2011/0100401 A1 5/2011 Fiorentini
2011/0107544 A1 5/2011 Lembo

FOREIGN PATENT DOCUMENTS

JP 2007106438 A * 4/2007
WO WO 2006010701 A1 * 2/2006
WO 2010075955 7/2010
WO 2010130373 11/2010
WO 2011026594 3/2011

OTHER PUBLICATIONS

J.A. Marchant and R. Green, "An Electrostatic Charging System for Hydraulic Spray Nozzles," Spray Physics Group, National Institute of Agricultural Engineering, Silsoe, Bedford, UK, Dec. 1981.

* cited by examiner

FIG. 12
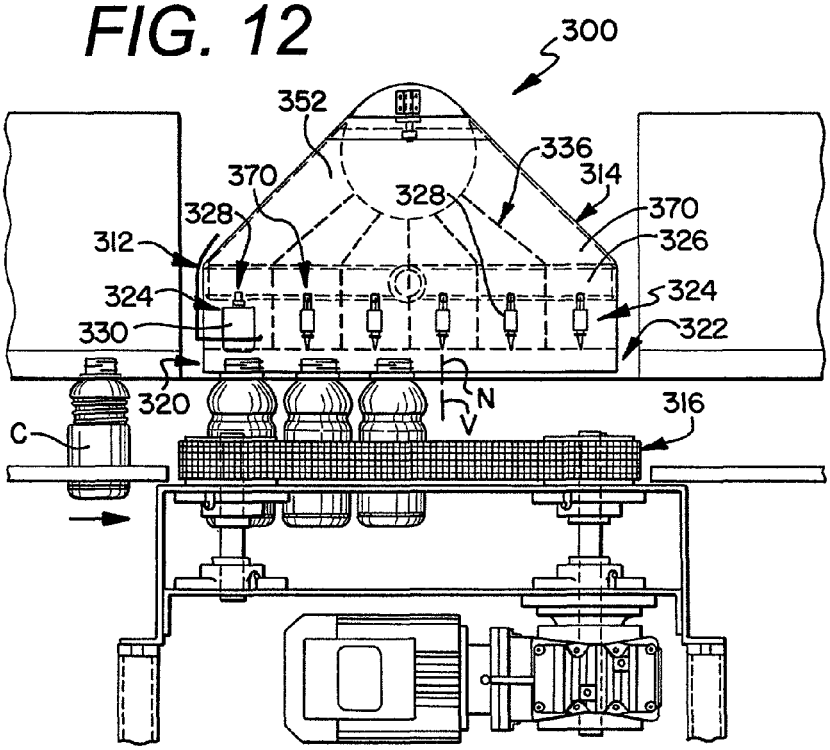
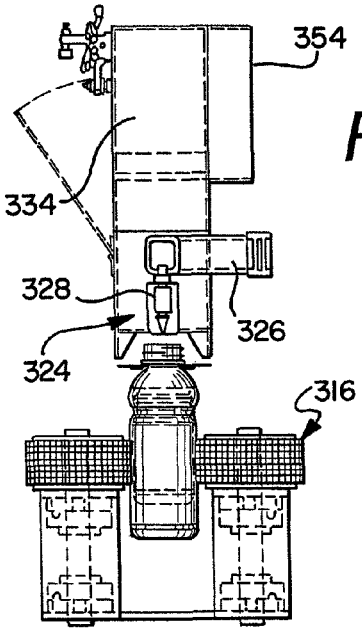
FIG. 13
FIG. 14
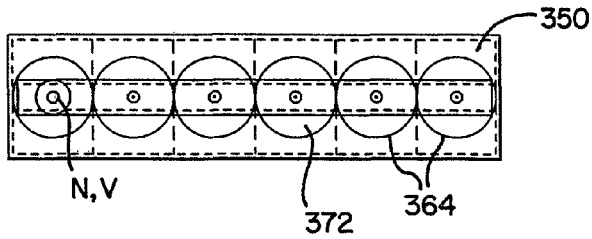

CONTAINER RINSING SYSTEM AND METHOD

RELATED APPLICATION

This application claims priority to and the benefit of U.S. Application No. 60/981,571 filed on Oct. 22, 2007 entitled "Container Rinsing System and Method," which is incorporated herein by reference and made a part hereof.

FIELD OF THE INVENTION

This invention relates generally to a container rinsing system and method, and more specifically to air rinsing of containers such as beverage bottles without the use of water or other elements that come into direct contact with the containers.

BACKGROUND

Empty containers, such as PET (polyethylene terephthalate) bottles, are known in the art as intended for filling with a liquid beverage. Such containers typically become contaminated with foreign material, such as paper, wood dust, or plastic debris during shipping, even when they are stored in boxes or other carrying receptacles. The bottles can also become contaminated as they are being processed prior to filling. During processing, contact between the containers and the surfaces of articles, such as conveyors or carriers, used to convey the containers, cause the containers to pick up a small amount of net electrostatic charge, thereby rendering the containers capable of attracting fine particles to the containers' internal and external walls. Thus, the need to rinse or otherwise clean the containers prior to filling is necessary to ensure that the beverages are acceptable to the ultimate consumer.

The dust particles contaminating these containers are characteristically extremely small, often measuring less than 10 microns in diameter. Any electrostatic charges on the containers induce opposite charges on the particles to attract and hold the particles on the containers' walls. To remove particles adhering to the walls, these opposite charges must be neutralized. Neutralizing the charges is difficult, however, because the charges holding each dust particle to a container wall are shielded by the dust particle itself. Moreover, once the electrostatic forces have been momentarily abated, the freed dust particles must be removed immediately before they re-attach themselves to a container.

Several prior art methods have been used to rinse the inside of a container or bottle. The methods include spraying the containers with water including hot water in certain methods. Methods using ozone or ozonated water as a sanitizing agent have also been used. Chemical disinfectants have typically been considered unsuitable such as in hot-fill operations. Finally, ionized gas streams have been used to rinse containers. Combinations of air and water rinsing have also been used. Certain disadvantages are associated with these methods including a greater use of energy and natural resources. In addition, these methods often require that the bottles be inverted prior to as well as during the rinsing process wherein gravity can assist in channeling contaminants away from the bottles. This requires additional bottle handling mechanisms to invert the bottles as well as to re-position the bottles right side up in preparation for filling with a liquid beverage.

Thus, while container rinsing systems according to the prior art provide a number of advantageous features, they nevertheless have certain limitations. The present invention seeks to overcome certain of these limitations and other drawbacks of the prior art, and to provide new features not heretofore available.

BRIEF SUMMARY

In one embodiment a container rinsing system is provided, such as for beverage containers wherein unwanted foreign particles are evacuated from the containers prior to being filled with a liquid beverage.

In accordance with a first aspect of the invention, a container rinsing system has an air nozzle adapted to be positioned proximate an opening of the container and adapted to direct a supply of compressed air to the container. A vacuum member is adapted to be in communication with a vacuum source. The vacuum member is positioned around the air nozzle and is adapted to vacuum foreign particles away from the container.

According to another aspect of the invention, the air nozzle has a nozzle central axis and the vacuum member has a vacuum central axis that is concentric with the nozzle central axis.

According to another aspect of the invention, the air nozzle is positioned to direct the supply of compressed air in a downward direction wherein the container is adapted to be positioned right side up.

According to a further aspect of the invention, the system has a plurality of air nozzles and a plurality of vacuum members. Each vacuum member has an air nozzle positioned therein. In one exemplary embodiment, a first air nozzle is an ionizing air nozzle and the remaining air nozzles are high velocity air nozzles. In a further exemplary embodiment, the plurality of nozzles includes a first ionizing air nozzle and the remaining nozzles comprise between 5 and 7 high velocity air nozzles.

According to a further aspect of the invention, the container rinsing system further has a guide positioned adjacent the air nozzle. The guide is adapted to engage a neck of the container for vertical alignment of the container in relation to the air nozzle.

According to a further aspect of the invention, the container rinsing system further has a conveyor adapted to move the container past the air nozzle and vacuum member. The conveyor has a first moving gripping member and a second moving gripping member, the gripping members configured to collectively grip the container. In one exemplary embodiment, the first moving gripping member moves at a rate of speed different from the second moving gripping member wherein the conveyor is adapted to rotate the container while moving the container through the rinsing system.

According to a further aspect of the invention, the conveyor may be in the form of an air conveyor. The air conveyor has a track assembly and a compressed air source. Containers are movably supported by the track assembly and the compressed air source moves the containers along the track and past the air nozzles and vacuum members.

It will be appreciated by those skilled in the art, given the benefit of the following description of certain exemplary embodiments of the container rinsing system disclosed herein, that at least certain embodiments of the invention have improved or alternative configurations suitable to provide enhanced benefits. These and other aspects, features and advantages of the invention or of certain embodiments of the invention will be further understood by those skilled in the art from the following description of exemplary embodiments taken in conjunction with the following drawings.

BRIEF DESCRIPTION OF THE DRAWINGS

To understand the present invention, it will now be described by way of example, with reference to the accompanying drawings in which:

FIG. 12 is a front elevation view of another alternative embodiment of a container rinsing system of the present invention and further partially showing a container handling system;

FIG. 13 is an end elevation view of the container rinsing system shown in FIG. 12 and showing an inlet of the system; and FIG. 14 is a bottom view of the container rinsing system shown in FIG. 13.

DETAILED DESCRIPTION OF CERTAIN EXEMPLARY EMBODIMENTS

Figure 1:
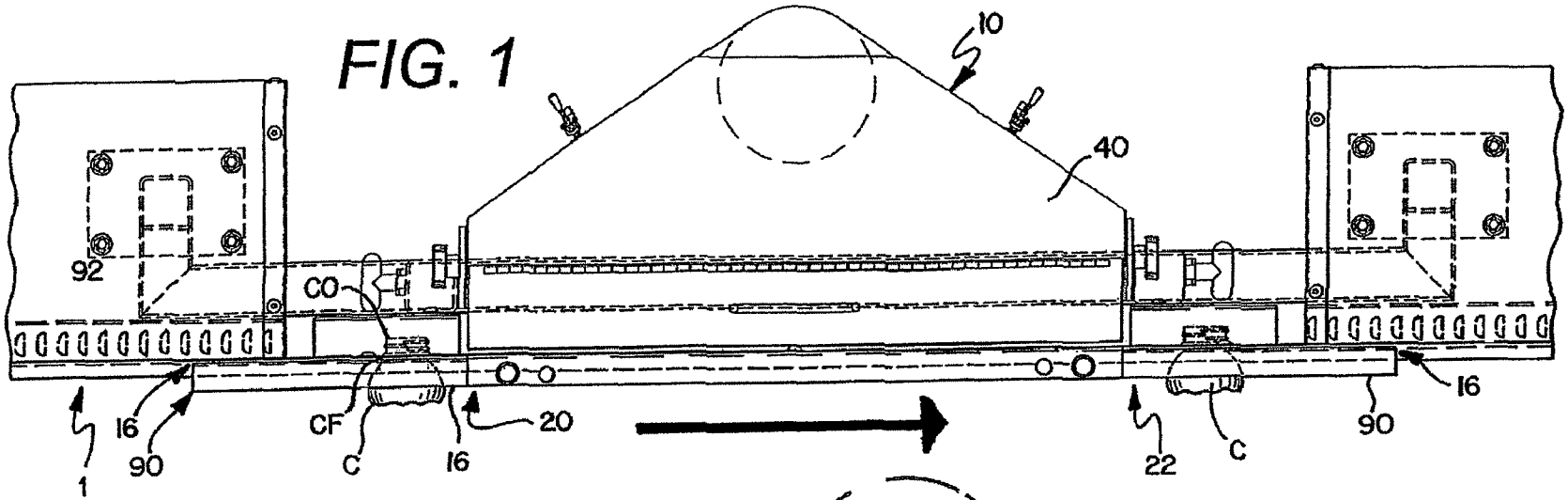
FIG. 1 is a front elevation view of a container rinsing system of the present invention and further partially showing a container handling system.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a container rinsing system generally designated with the reference numeral 10. The container rinsing system 10 generally includes a nozzle assembly 12 and a vacuum assembly 14. In one exemplary embodiment of the invention, the container rinsing system 10 is typically operably associated with a conveyor 16. It is understood, however, that the conveyor 16 is not essential to the container rinsing system 10.

It is understood that the container rinsing system 10 is used in conjunction with a larger container processing assembly line 1 (not completely shown), or container handling system 1. It is understood the container processing assembly line 1 includes various known conveyor assemblies and other handling apparatuses for preparing containers such as beverage bottles, optional additional rinsing of the containers, filling the containers with a beverage or liquid and capping the containers for subsequent shipment for consumption. It is further understood that the assembly line 1 including the container rinsing system 10 transports containers at a high rate of speed, typically in the range of 600-800 bottles per minute.

Figure 2:
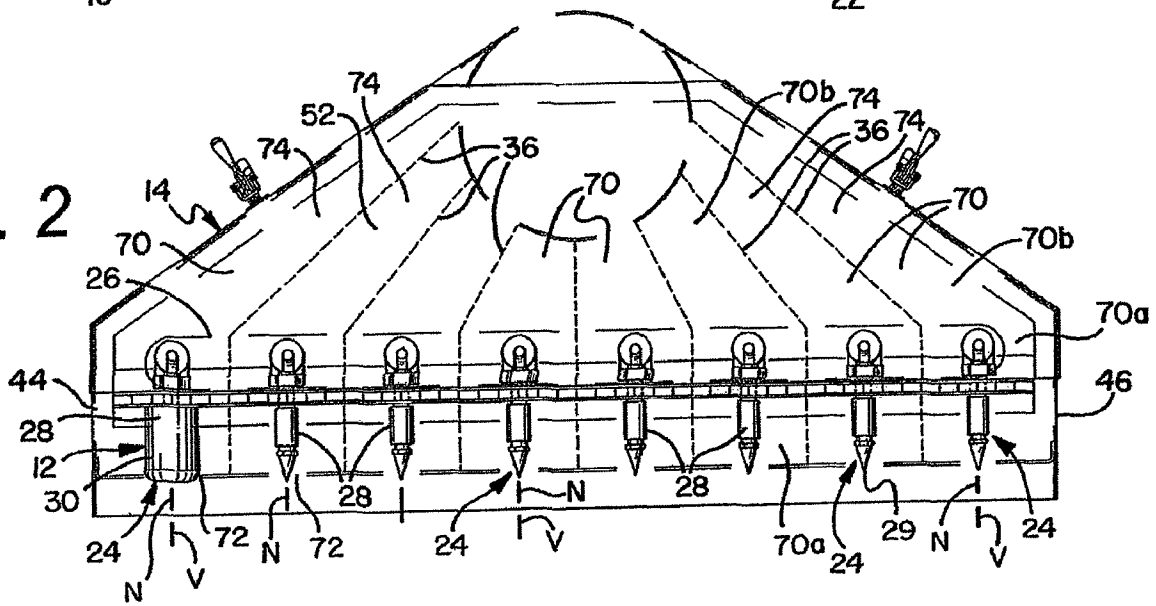
FIG. 2 is a front elevation view of the container rinsing system shown in FIG. 1.
Figure 3:
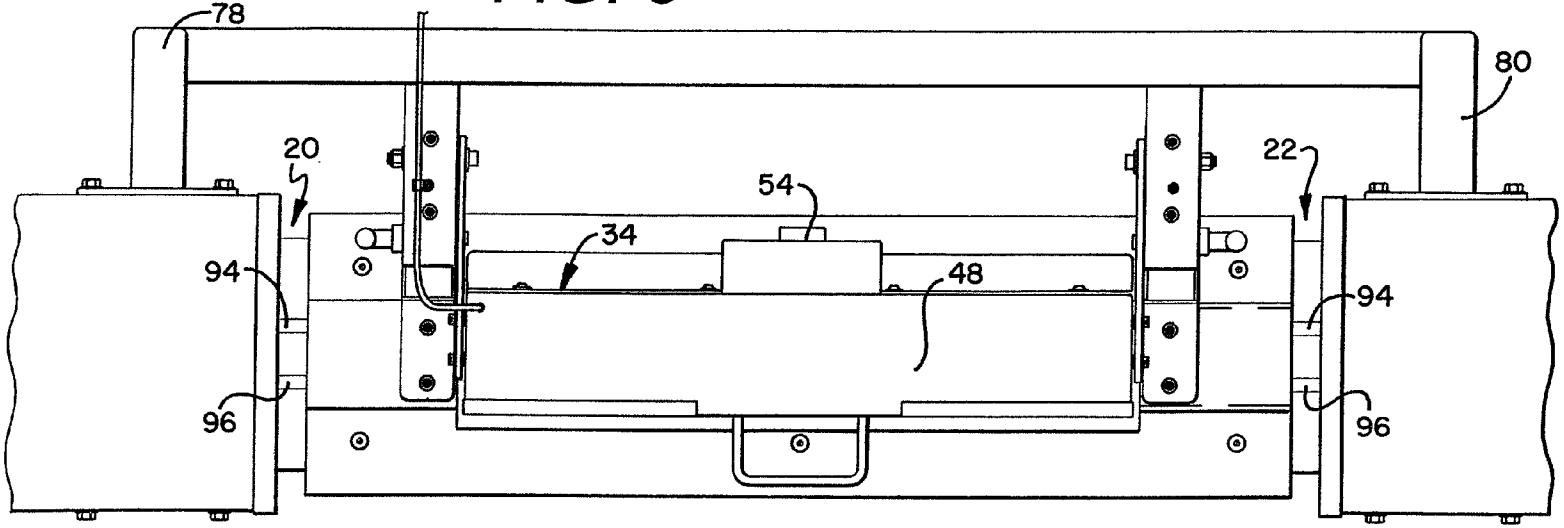
FIG. 3 is a plan view of the container rinsing system shown in FIG. 1.

As shown in FIGS. 1-3, the container rinsing system 10 is positioned along one portion of the container processing assembly line 1. The container rinsing system 10 has a first end 20, or inlet end 20, and a second end 22, or outlet end 22. As will be described in greater detail below, the vacuum assembly 14 may include a housing that defines the inlet end 20 and the outlet end 22. The assembly line 1 delivers a plurality of containers C to the inlet end 20. The conveyor 16 of the container rinsing system 10 then transports the containers C through the rinsing system 10 and past the outlet end 22. The containers C are then transported to other portions of the assembly line 1 for further processing. In one exemplary embodiment of the invention, the containers C are bottles having a bottle finish CF and having a container opening CO to be filled with a liquid beverage. The bottle finish CF may also have a neck ring extending around a circumference of the container C.

As will be explained in greater detail below, the nozzle assembly 12 has a plurality of nozzles and the vacuum assembly 14 has a plurality of vacuum members. In one simple form, a respective nozzle is operably associated with a respective vacuum member to form a rinsing module 24. In particular, the nozzle 12 is positioned within the vacuum member 14 wherein the vacuum member 14 generally surrounds the nozzle 12. The rinsing system 10 utilizes a plurality of rinsing modules 24 arranged in series in one exemplary embodiment of the invention.

Figure 4:
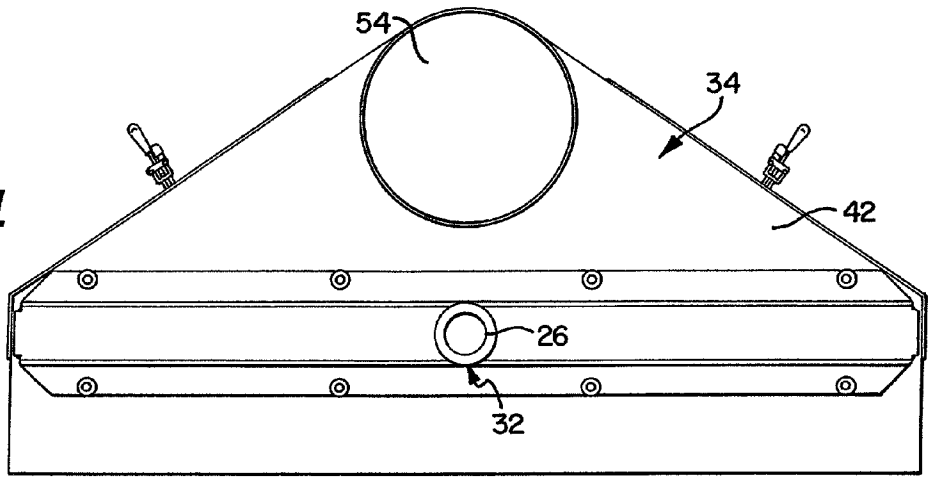
FIG. 4 is a rear elevation view of the container rinsing system shown in FIG. 1.
Figure 7:
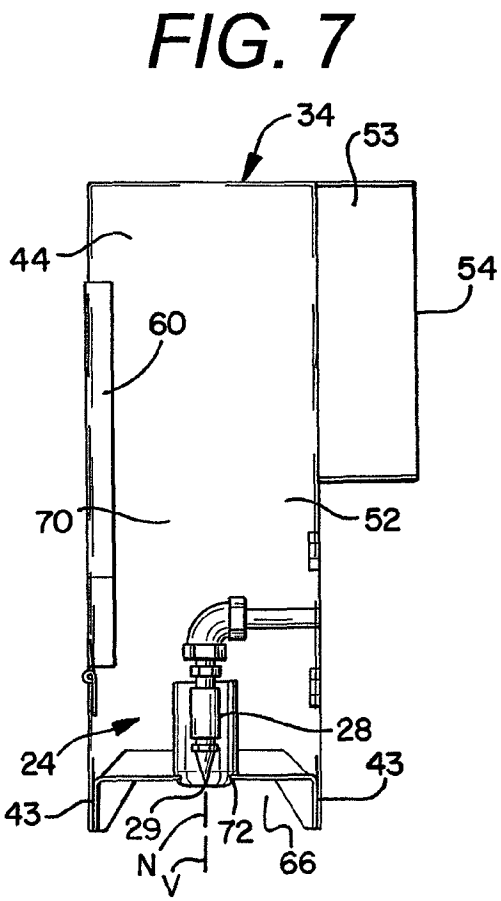
FIG. 7 is an end view of the container rinsing system shown in FIG. 1 and showing an outlet of the system.
Figure 8:
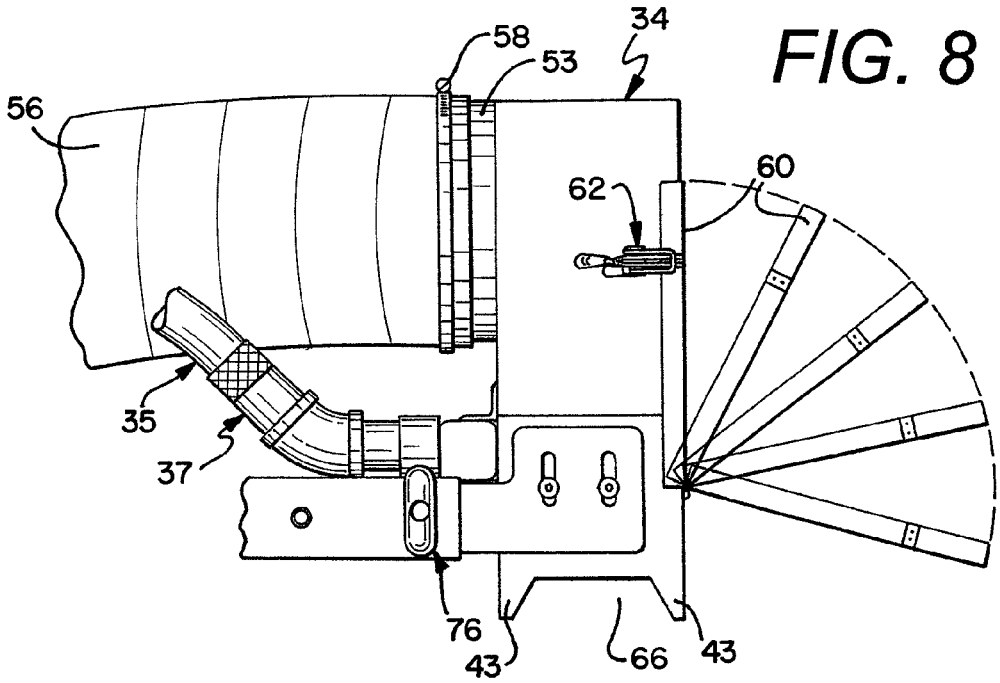
FIG. 8 is an end view of the container rinsing system shown in FIG. 6 and showing additional components of the system.

FIGS. 2 and 7 further show the nozzle assembly 12. The nozzle assembly 12 generally includes a nozzle manifold 26 and a plurality of individual nozzles 28 in fluid communication with the manifold 26. One of the individual nozzles 28 is an ionizing nozzle 30 having suitable electrical connections. As shown in FIGS. 4 and 8, the nozzle manifold 26 has a central inlet opening 32 that receives an air supply hose 35 via a quick disconnect-type fitting 37 (FIG. 8). In one exemplary embodiment of the invention, the plurality of nozzles are eight nozzles 24 including the one ionizing nozzle 30 and seven high speed air jet nozzles 28. The nozzles 28 are spaced along the nozzle manifold 26 from proximate the inlet 20 of the system 10 and the outlet 22 of the system 10. The nozzles 28 are spaced generally equidistant along the rinsing system 10. The nozzles 28, 30 are positioned such that distal ends 29 of the nozzles 28 are directed in a downward direction. As explained in greater detail below, the nozzle assembly 12 is operably associated with the vacuum assembly 14. Thus, the nozzle manifold 26 is contained within the vacuum assembly 14 and the central inlet opening 32 is positioned in a corresponding opening in a rear portion of the vacuum assembly 14. As discussed in greater detail below, the nozzles 28 generally have a nozzle central axis N.

FIGS. 1-9 further show the vacuum assembly 14. The vacuum assembly 14 generally includes a housing 34 having a plurality of inner walls 36 defining a plurality of vacuum members 70.

The housing 34 has a front wall 40, a rear wall 42, a first end wall 44, a second end wall 46, a top wall 48 and a bottom wall 50. The walls 40-50 are connected together to form an inner cavity 52. As shown in FIGS. 4 and 8, the rear wall 42 has an outlet opening 54. The outlet opening 54 is in communication with the inner cavity 52. The outlet opening 54 is located proximate a top of the rear wall 42 and the housing 34 generally tapers towards the outlet opening 54. The housing 34 may have an extension member 53 defining the outlet opening 54. The outlet opening 54 is connected to a vacuum hose 56 (FIG. 8) via a quick release clamp 58 to be described in greater detail below. The rear wall 42 further has an aperture to accommodate the nozzle manifold 26. The front wall 40 has a front access door 60 hingedly connected to the housing 34 providing selective access to the vacuum assembly 14 via a door latch 62.

Figure 5:
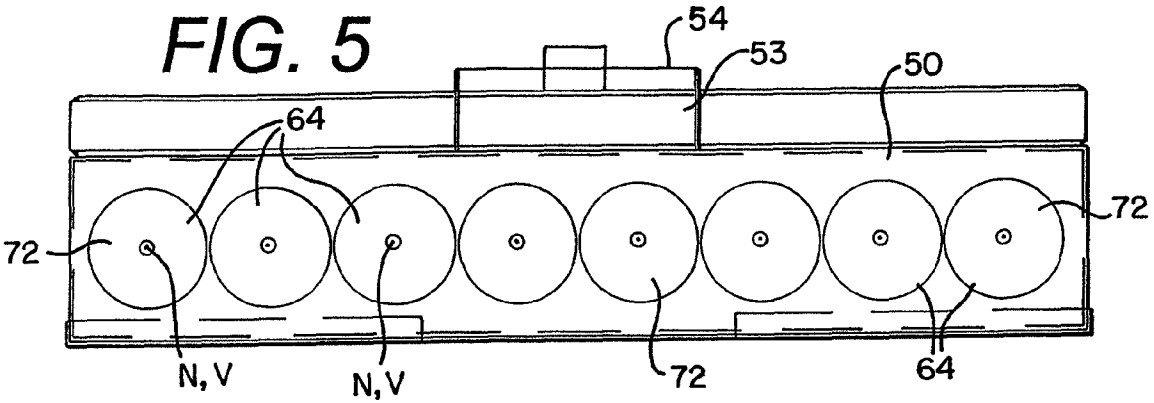
FIG. 5 is a bottom view of the container rinsing system shown in FIG. 1.
Figure 6:
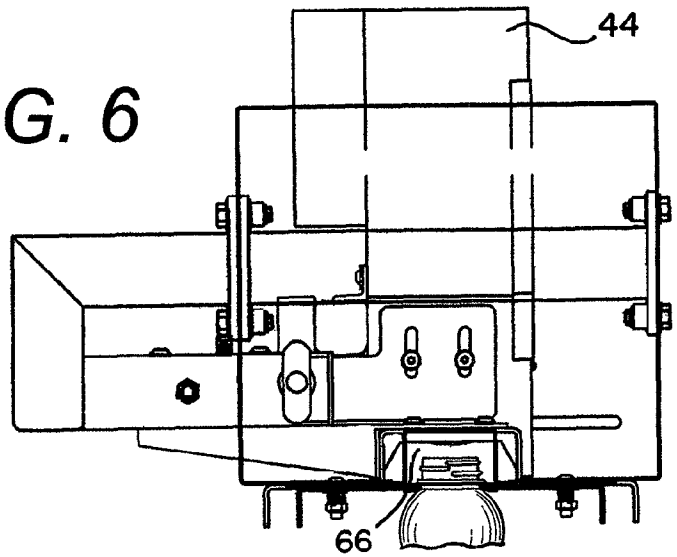
FIG. 6 is an end view of the container rinsing system shown in FIG. 1 and showing an inlet of the system.

As shown in FIGS. 5-7, the bottom wall 50 has a plurality of bottom openings 64 therein. In one exemplary embodiment, the bottom openings 64 are circular although other shapes are possible such as square or rectangular. The bottom wall 50 is spaced upwards from distal ends of the front wall 40 and rear wall 42. The distal ends of the front wall 40 and the rear wall 42 form depending legs 43 that define a channel 66 extending from the rinsing system inlet 20 to the rinsing system outlet 22. As shown in FIG. 2, the inner walls 36 are positioned in the inner cavity 52 of the housing 34. The inner walls 36 define a plurality of vacuum members 70. The vacuum members 70 may have various cross-sectional configurations including circular, square or rectangular. Each bottom opening 64 defines a vacuum member inlet 72. Each vacuum member 70 is a duct that defines a passageway 74 extending from the bottom opening 64, or vacuum member inlet 72 to the outlet opening 54. The vacuum members 70 are separate from one another. In addition, the vacuum members 70 have a first segment 70*a* that has a general vertical orientation and a second segment 70*b* that has an angled orientation extending and converging to the outlet opening 54. As further shown in FIG. 2, the vacuum members 70 extend to the outlet opening via each respective second segment 70*b* wherein the vacuum members 70 share a common outlet in the form of the outlet opening 54. It is understood that the vacuum members 70 could have separate outlet openings as well as segments having only a vertical orientation. As discussed in greater detail below, the vacuum members 70 generally have a vacuum member central axis V.

As shown in FIGS. 1, 3, 8 and 9, a support structure 76 is associated with the housing 34. The support structure has a first arm 78 connected at one end of the housing 34 and a second arm 80 connected at an opposite end of the housing 34. The arms 78, 80 are connected to the housing 34 via adjustment bolts 82 that cooperate in slots 84 positioned in the arms 78, 80. This connection configuration allows for adjustment of the rinsing system height as described in greater detail below. The support arms 78, 80 also have hinge release knobs 86 for further manipulation of the housing 34 of the rinsing system 10.

As discussed, the nozzle assembly 12 is operably associated with the vacuum assembly 14. As further shown in FIGS. 2 and 5-7, the nozzle manifold 26 is positioned within the housing inner cavity 52. The inlet 32 of the nozzle manifold 26 is positioned in the aperture of the rear wall 42. Each nozzle 28 is in communication with and extends from the nozzle manifold 26. Each nozzle 28 extends in a respective vacuum member 70 and in a generally vertical orientation wherein the nozzle 28 is directed in a downward direction. The vacuum member 70 is thus positioned around the nozzle 28. Furthermore, it is understood that the vacuum member 70 defines an outer periphery wherein the nozzle 28 is positioned within the outer periphery of the vacuum member 70. The nozzle 28 extends in the first segment 70*a* of the vacuum member 70. A distal end 29 of each nozzle 28 is positioned proximate the bottom openings 64 at the respective inlets 72 of each vacuum member 70. In addition, in an exemplary embodiment, the nozzle 28 is positioned generally at a center of the vacuum inlets 72. Thus, the nozzle central axis N is generally coincident or concentric with the vacuum member central axis V. In this configuration, the nozzle 28 is considered to be generally concentric or coincident with the vacuum member 70. The nozzle 28 and vacuum member 70 are considered to have a common central axis in an exemplary embodiment. Other configurations are possible wherein the central axes may be offset while the vacuum member 70 still surrounds or is placed around the nozzle 28. In embodiments where the bottom opening 64 may have other shapes such as square or rectangular, the nozzle 28 is positioned to be generally centered in such a bottom opening. This may also be considered a concentric-type configuration. These structures may be considered to share a common center.

It is understood that the inner walls 36 have appropriate access openings to accommodate the nozzle manifold 26 and nozzles 28 which are sealed to maintain separation between the vacuum members 70. As further shown in FIG. 2, the ionizing nozzle 30 is positioned at the first vacuum member 70 proximate the inlet 20 of the rinsing system 10. A respective nozzle 28 is positioned as described above in a respective vacuum member 70 in concentric fashion. The distal end 29 of the nozzle 28 is positioned proximate the vacuum inlet 72 and does not extend past the bottom wall 50, such that the distal end 29 of the nozzle 28 is positioned at substantially the same height as the vacuum inlet 72. The distal end 29 can extend or protrude slightly past or be positioned above the bottom wall 50 in other embodiments. The nozzle manifold 26 can be adjusted relative to the housing 34 to achieve such configurations. The nozzles 28 could also be provided with structure for individual adjustment.

Each respective nozzle 28 and vacuum member 70 is considered to define the rinsing module 24. In one exemplary embodiment, the rinsing system 10 has eight rinsing modules 24 wherein eight nozzles 28 are positioned in eight vacuum members 70. While in an exemplary embodiment, the nozzles 28 and vacuum members 70 lead to a common communication conduit (nozzle manifold 26, vacuum outlet 54), it is understood that each nozzle 28 and vacuum member 70 can be separate from one another and be connected to a separate air and vacuum source.

As further shown in FIG. 8, the vacuum hose 56 is connected to the outlet opening 54 at the housing 34 wherein the vacuum hose 56 is in fluid communication with all of the vacuum members 70. The vacuum hose 56 is connected to a suitable vacuum source. The nozzle inlet 32 is connected to the air supply hose 35 with the quick-disconnect fitting 37 wherein the air supply hose 35 is connected to a suitable pressurized, compressed air source. It is understood that such compressed air is suitably filtered.

As discussed, the conveyor 16 is operably associated with the rinsing system 10 as well as other components of the overall container handling system 1. In the exemplary embodiment shown in FIGS. 1-9, the conveyor 16 (FIG. 1) has a track assembly 90 and pressurized air ducts 92. The track assembly 90 includes a first track member 94 spaced from a second track member 96 (FIG. 3). The track members 94, 96 receive and support the container finish CF wherein the neck ring on the container C rides along the track members 94, 96. The spacing between the track members 94, 96 is adjustable to accommodate different sized containers C. A pressurized air source is provided wherein pressurized air is directed at the containers C through the ducts 92. Thus, as shown in FIG. 1, the container C is moved along the track members 94, 96 in the direction of the arrow by the pressurized air directed onto the containers C.

Figure 9:
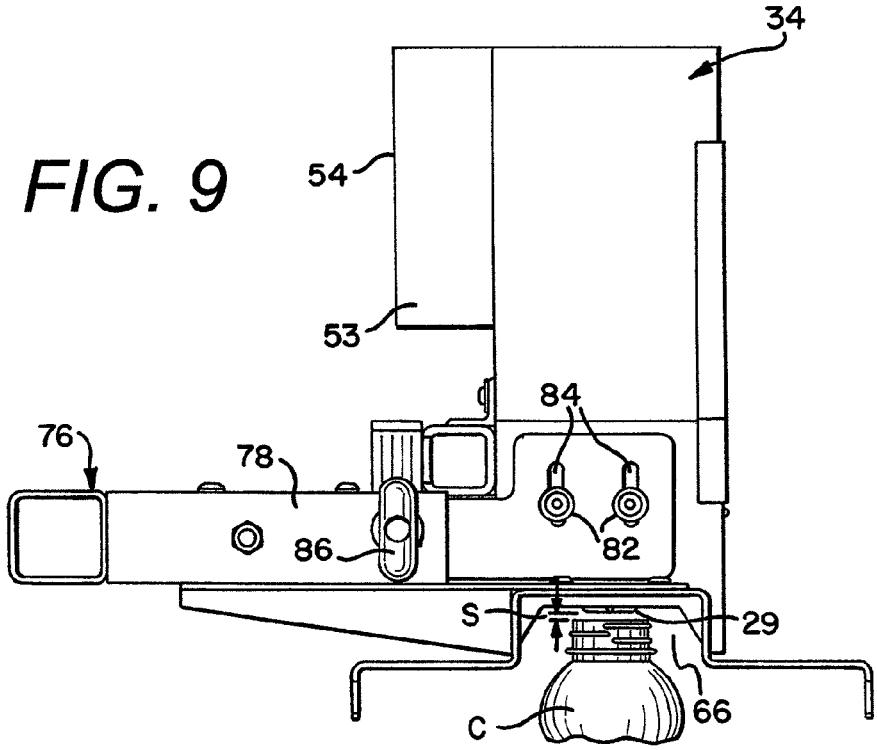
FIG. 9 is an end view of the container rinsing system shown in FIG. 6 and showing a container adjacent to an air nozzle and vacuum member.

As shown in FIG. 1, the container rinsing system 10 is operably connected with other components of the overall container handling system 1. The container rinsing system 10 is positioned along the handling system 1 such as shown in FIG. 1. The height of the housing 34 is set accordingly such that the containers C will pass through the rinsing system 10 at a desired predetermined spacing S (FIG. 9). In one exemplary embodiment, the spacing S may be ⅛ in. This spacing S can vary. It is desirable to have as minimal spacing S as possible such that the rinsing module 24 is as close to the container opening CO as possible while allowing clearance for the containers C to pass through the rinsing system 10. The conveyor 16 is operably connected with other conveyor members in order to receive containers C from the handling system 1 and to deliver the rinsed containers C exiting the rinsing system 10 for further processing by the container handling system 1. It is understood the pressurized air source for the conveyor 16 is energized. The vacuum hose 56 is connected to the vacuum assembly outlet 54 and the vacuum source is energized. In addition, the air supply hose 35 is connected to the nozzle manifold 26 and the pressure air source for the nozzle assembly 12 is energized. It is also understood that the housing 34 and conveyor 16 can be mounted having a minimal slope to assist in the movement of the containers C along the tracks 94, 96.

In any of the above embodiments, the unit can be provided with automatic shut-off switches. The switches can be arranged with sensors for detecting whether air is being supplied to the system from the nozzles or whether the vacuum members are providing suction.

Operation of the container rinsing system will now be described. With the handling system 1 and conveyor 16 energized, a container C is conveyed to the inlet 20 of the rinsing system 10 wherein the neck ring on the container finish CF rides along the track members 94, 96. The track members 94, 96 serve as a guide to engage the neck of the container C for vertical alignment of the container C in relation to the nozzle 28 and vacuum member 70. The container C is conveyed in an upright fashion wherein the container opening CO faces upwards. It is understood that a plurality of adjacent containers C are conveyed one after another by the conveyor 16. The container C passes through the channel 66 (FIG. 9) defined by the housing 34. As the container C reaches the first rinsing module 24, pressurized ionized air from the first ionizing nozzle 30 is injected into the container C through the container opening CO. The nozzle 30 directs the compressed air in a downwards direction. This pressurized air dislodges foreign particles, contaminants etc. from the surfaces of the container C. The ionized air also neutralizes the inside and outside surfaces of the container C preventing particles from unduly adhering themselves to the surfaces. At the same time, the vacuum member 70 provides suction to the container C wherein any such particles or contaminants are directed away from the container C. The vacuum members 70 provide suction in an upward direction. The container C continues to be conveyed along the conveyor 16 and through the rinsing system 10 wherein the container C passes through each successive rinsing module 24 positioned in series. Accordingly, the container C is subjected to pressurized air from each nozzle 28 and suction from each vacuum member 70 from the remaining seven nozzle/vacuum members of the rinsing modules 24 of the rinsing system 10. The configuration of the rinsing modules 24 provide an operational zone around each nozzle 28 to immediately pick up foreign particles and contaminants and direct such particles through the vacuum members 70 and through the vacuum hose 56. Accordingly, the container C is suitably rinsed wherein foreign particles or contaminants are dislodged from the surfaces of the containers C by the nozzles 28 and the vacuum members 70 simultaneously remove the foreign particles or contaminants from the containers C before any foreign particles re-adhere to the containers C. The containers C continue along the conveyor 10 and to other portions of the container handling system 1 to be filled, capped and prepared for shipment.

It is understood that the containers C move at considerable speeds through the system 10. The system 10 is capable of rinsing containers at 600-800 containers per minute wherein the container C is at each rinsing module 24 for fractions of a second. The pressurized filtered air can be provided at various pressures and in one exemplary embodiment, the pressurized air is at 40-70 psi. As discussed the predetermined spacing S can be varied as desired and can be ⅛ in. in one embodiment. By loosening the adjustment bolts 82, the housing 34 can be vertically adjusted via the slots 84 to vary the spacing S. The knobs 86 can also be used to tilt the housing 34 when cleaning or servicing the system 10. The access door 60 also provides easy access into the housing 34 to adjust the nozzle assembly 12, perform maintenance or clean the nozzle assembly 12 or vacuum assembly 14. The vacuum hose 56 and air supply hose 35 are also easily removable. Generally, the rinsing system 10 can be easily and rapidly adjusted as desired. In other variations, rinsing modules 24 can be set up to travel with the containers C for rinsing.

Figure 11:
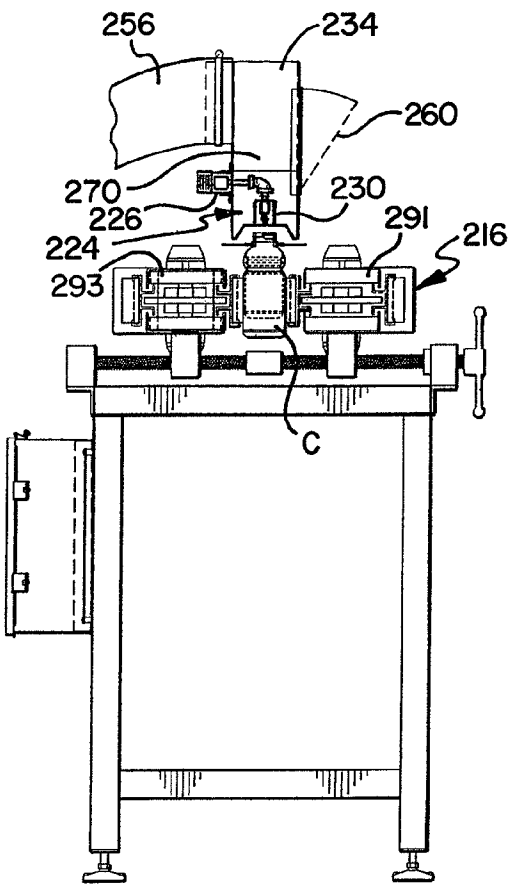
FIG. 11 is an end view of the container rinsing system shown in FIG. 10, and showing an inlet of the system.
Figure 10:
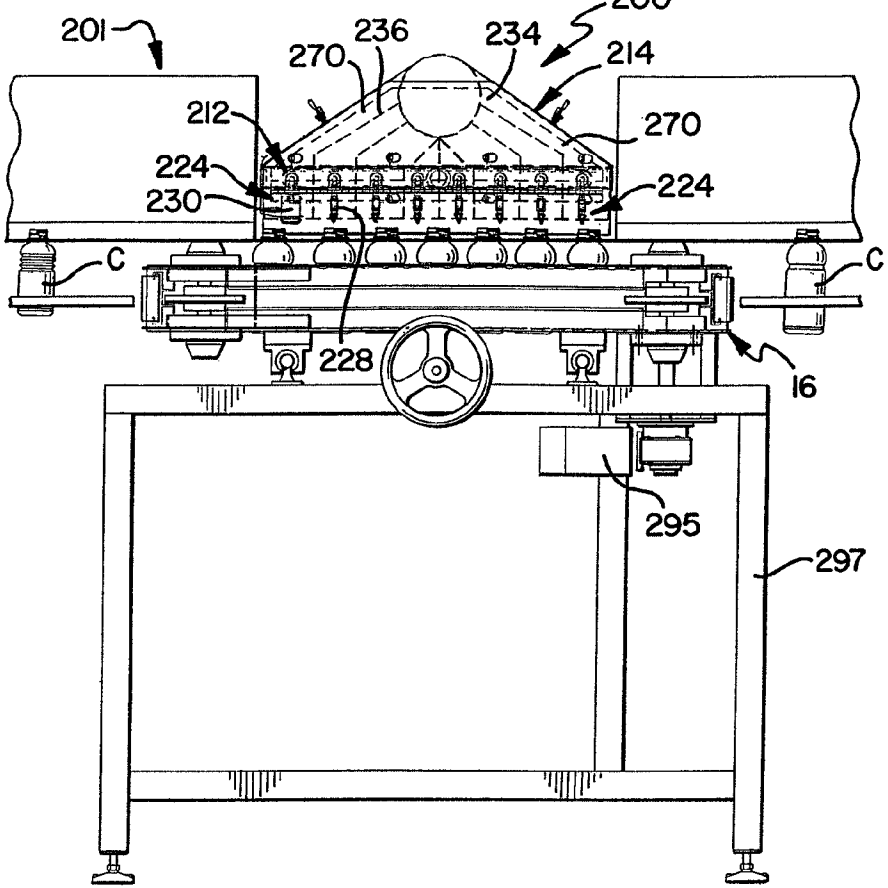
FIG. 10 is a front elevation view of an alternative embodiment of a container rinsing system of the present invention and further partially showing a container handling system.

FIGS. 10-11 disclose an alternative embodiment of a container rinsing system of the present invention, generally designated with the reference numeral 200. Many components are similar to the rinsing system shown in FIGS. 1-9 and will be designated with similar reference numerals in the 200 series of reference numerals.

In this embodiment the container rinsing system 10 is generally the same as the container rinsing system 10 shown in FIGS. 1-9. The system 200 utilizes eight rinsing modules 224 constructed as described above. A belt-driven conveyor 216 is provided in this embodiment to convey the containers C through the rinsing system 200.

The conveyor 216 generally includes a first gripper member 291, a second gripper member 293 and a motor 295. These components are generally supported by a frame 297 that may rest on a floor or other support surface. Each gripper member 291, 293 have a rotatable belt and other supporting structure as is known. The first gripper member 291 is spaced from the second gripper member 293 a predetermined distance to accommodate the containers C. As shown in FIG. 11, this spacing is adjustable to accommodate containers having various diameters. The motor 295 is operably connected to the first gripper member 291 and the second gripper member 293 as shown in FIG. 10. It is understood that the rinsing system 200 is supported by suitable support members above the conveyor 216 as is desired for the containers C to pass through the rinsing system 200 at the desired spacing.

In operation, the first and second gripper members 291, 293 are rotated by the motor. Containers C are received from the container handling system 1 wherein the gripper members 291, 293 grip the containers C and convey the containers C through the rinsing system 200. The rinsing system 200 rinses the containers C as described above. The gripper members 291, 293 convey the containers C to other portions of the container handling system 1 for further processing. It is understood that the operable connections between the motor 295 and first gripper member 291 and second gripper member 293 can be such that one gripper member rotates at a greater speed relative to the other gripper member. In this fashion, the container C is also rotated about its center point as the container C moves linearly through the rinsing system 200. This can assist in the rinsing process.

FIGS. 12-14 disclose another alternative embodiment of a container rinsing system of the present invention, generally designated with the reference numeral 300. Certain components are similar to the rinsing system shown in FIGS. 1-9 and FIGS. 10-11 and will be designated with similar reference numerals in the 300 series.

In this embodiment, the conveyor 316 is generally the same in the embodiment of FIGS. 10-11. The rinsing system 300 is also similar to the rinsing system of FIGS. 1-9, but uses six rinsing modules 324. As such, the housing 334 has inner walls 336 that separate the inner cavity 352 into six vacuum members 370. The nozzle manifold 326 supplies pressurized air to the six air nozzles 328. The first air nozzle 330 is an ionized air nozzle and the remaining five nozzles are high speed air jet nozzles. Each nozzle 330 is positioned in concentric fashion within the vacuum member 370 consistent with the above description.

In operation, containers C are conveyed through the rinsing system 300 by the conveyor 316 operating in similar fashion to the conveyor of FIGS. 11-12. The rinsing system 300 also operates in similar fashion wherein the nozzle assembly 312 supplies pressurized air in a downward direction while the vacuum assembly 314 supplies suction in an upward direction. The containers C pass by each rinsing module 324 and are then directed to additional portions of the container handling system 1 for further processing.

In any of the above embodiments, if either of the sensors connected to the vacuum members or the nozzles senses a lack of suction or a lack of air pressure respectively, the system is automatically shut down via an automatic shut-off switch.

The container rinsing system of the present invention provides several benefits. Because the system is an air-only system as opposed to a water-based system or combination air/water system, the system uses fewer natural resources such as water and electricity. In addition, with this design, there is no need to invert the containers as the rinsing module is capable of rinsing the containers in an upright configuration. This simplifies the system providing increased speed, less air use, and less capital expense as no equipment is required for inverting the containers. The rinsing system also has a small footprint saving on facility space. Previous designs required a larger footprint and more structure and components. The design also allows the nozzles to be positioned closer to the bottle finish enhancing rinsing capabilities. Because the system components, including the housing and conveyor, can be easily adjusted, rapid change-over of the system is achieved for differently-sized bottles. Use of the ionizing air nozzle neutralizes electrostatic charges both on inside and outside surfaces of the containers. The access door for the housing and ability to tilt the housing allows ready access for sanitation and maintenance of the system. Overall, because of its simplified structure and operation, the rinsing system is less expensive to fabricate, operate and maintain in comparison with other designs.

Given the benefit of the above disclosure and description of exemplary embodiments, it will be apparent to those skilled in the art that numerous alternative and different embodiments are possible in keeping with the general principles of the invention disclosed here. Those skilled in this art will recognize that all such various modifications and alternative embodiments are within the true scope and spirit of the invention. The appended claims are intended to cover all such modifications and alternative embodiments. It should be understood that the use of a singular indefinite or definite article (e.g., "a," "an," "the," etc.) in this disclosure and in the following claims follows the traditional approach in patents of meaning "at least one" unless in a particular instance it is clear from context that the term is intended in that particular instance to mean specifically one and only one. Likewise, the term "comprising" is open ended, not excluding additional items, features, components, etc.

What is claimed is:

1. A container rinsing system comprising:

an air nozzle defining a central axis, the air nozzle adapted to be positioned proximate an opening of a container, and adapted to direct a supply of compressed air to the container; and a vacuum member forming a duct that defines a passageway and wherein the duct further comprises a vacuum central axis and a vacuum inlet, the vacuum member connected to a vacuum source, the vacuum member positioned around the air nozzle, and the vacuum member adapted to vacuum foreign particles away from the container;

wherein the vacuum central axis is generally concentric with the nozzle central axis and a distal end of the nozzle is positioned proximate the vacuum inlet such that the distal end of the nozzle is positioned at substantially the same height as the vacuum inlet.

2. The container rinsing system of claim 1 wherein the air nozzle is positioned to direct the supply of compressed air in a downward direction into a right-side-up container.

3. The container rinsing system of claim 1 wherein the air nozzle is an ionizing air nozzle adapted to deliver a supply of ionized air.

4. The container rinsing system of claim 1 further comprising a second air nozzle positioned generally adjacent the air nozzle.

5. The container rinsing system of claim 4 further comprising a second vacuum member positioned around the second air nozzle.

6. The container rinsing system of claim 1 further comprising a plurality of air nozzles.

7. The container rinsing system of claim 6 further comprising a plurality of vacuum members, wherein each vacuum member is positioned around a respective air nozzle.

8. The container rinsing system of claim 7 wherein the plurality of air nozzles includes an ionizing air nozzle and a plurality of high velocity air nozzles positioned in series adjacent to the ionizing air nozzle.

9. The container rinsing system of claim 8 wherein the plurality of vacuum members converge with one another and are adapted to be collectively in communication with the vacuum source.

10. The container rinsing system of claim 1 further comprising a guide positioned adjacent the air nozzle, the guide adapted to engage a neck of the container for vertical alignment of the container in relation to the air nozzle.

11. The container rinsing system of claim 1 further comprising a conveyor adapted to move the container past the air nozzle and the vacuum member.

12. The container rinsing system of claim 11 wherein the conveyor comprises a first moving gripping member and a second moving gripping member, the gripping members configured to collectively grip the container.

13. The container rinsing system of claim 12 wherein the first moving gripping member moves at a rate of speed different from the second moving gripping member wherein the conveyor is adapted to rotate the container while moving the container past the air nozzle and the vacuum member.

14. The container rinsing system of claim 6 wherein the plurality of air nozzles includes a first ionizing air nozzle and the remaining air nozzles comprise between 5 and 7 high velocity air nozzles.

15. A container rinsing system comprising:

a vacuum member forming a duct that defines a passageway and wherein the duct further comprises an outer periphery and a vacuum central axis, wherein the vacuum member is connected to a vacuum source; and an air nozzle defining a nozzle central axis, the air nozzle positioned within the outer periphery of the vacuum member, the air nozzle adapted to be positioned proximate an opening of a container, and adapted to direct a supply of compressed air to the container; and wherein the vacuum central axis is generally concentric with the nozzle central axis and a distal end of the nozzle is positioned proximate the vacuum inlet such that the distal end of the nozzle is positioned at substantially the same height as the vacuum inlet.

16. A container rinsing system for rinsing polyethylene terephthalate (PET) bottles, the system comprising:

a rinsing module having a vacuum member forming a duct that defines a passageway and wherein the duct further comprises an outer periphery, a vacuum inlet, a vacuum central axis, and the vacuum member connected to a vacuum source, the module further having an air nozzle defining a central axis, positioned within the outer periphery of the vacuum member, and the air nozzle adapted to direct a supply of compressed air to the container and wherein the vacuum central axis is generally concentric with the nozzle central axis and a distal end of the nozzle is positioned proximate the vacuum inlet such that the distal end of the nozzle is positioned at substantially the same height as the vacuum inlet.

17. The container rinsing system of claim 16 wherein the rinsing module comprises a plurality of rinsing modules positioned adjacent one another.

18. The container rinsing system of claim 17 wherein the first rinsing module includes an ionizing air nozzle.

19. The container rinsing system of claim 18 wherein rinsing modules adjacent the first rinsing module comprise a high pressure air nozzle.

20. The container rinsing system of claim 16 wherein the air nozzle has a distal end and the vacuum member has an inlet at the outer periphery; and wherein the distal end of the air nozzle is positioned proximate to the inlet of the vacuum member.

21. A method of rinsing containers passing through a container rinsing system comprising:

providing a plurality of vacuum members, each vacuum member forming a duct that defines a passageway and wherein each duct further comprises an outer periphery, a vacuum inlet, and a vacuum central axis and further providing a plurality of air nozzles, each air nozzle defining a nozzle central axis, a respective air nozzle being positioned within a respective vacuum member wherein a distal end of the nozzle is positioned proximate the vacuum inlet such that the distal end of the nozzle is positioned at substantially the same height as the vacuum inlet, wherein each vacuum member is connected to a vacuum source;

positioning the nozzle central axis concentric with the vacuum central axis;

passing a plurality of containers by the vacuum members and air nozzles;

supplying compressed air towards the containers and along the nozzle central axis; and vacuuming unwanted foreign particles away from the container.

22. A container rinsing system for removing foreign particles from empty polyethylene terephthalate (PET) containers moving along an assembly line in a predetermined container flow path prior to being filled with a liquid beverage, each container having an open end, the container rinsing system comprising:

a vacuum assembly positioned along the container flow path, the vacuum assembly having a housing having a plurality of vacuum members, each vacuum member defining a vacuum duct, each vacuum duct having a vacuum inlet and a vacuum outlet, the vacuum inlet defined by a generally circular aperture, and wherein the respective vacuum outlets are connected to a vacuum source, the housing further having a pair of depending legs proximate the inlets of the vacuum duct defining a rinsing channel along the predetermined container flow path;

a nozzle assembly positioned in the housing and having a nozzle manifold and a plurality of nozzles extending from and in fluid communication with the nozzle manifold, wherein the nozzle manifold is connected to a compressed air source, a respective nozzle positioned within a respective vacuum duct wherein a distal end of the nozzle is positioned proximate the vacuum inlet such that the distal end of the nozzle is positioned at substantially the same height as the vacuum inlet, and wherein a first nozzle is an ionizing air nozzle and is positioned in a first vacuum duct, the nozzles other than the first nozzle being high velocity air nozzles; and a conveyor positioned adjacent the housing, the conveyor configured to transport the container through the rinsing channel and past the plurality of vacuum members and nozzles, wherein the first nozzle directs ionized air to the containers and the other nozzles direct high velocity compressed air to the containers and wherein the vacuum members provide a suction force to evacuate unwanted foreign particles away from the containers.

23. The container rinsing system of claim 22 wherein the plurality of nozzles are positioned to direct compressed air in a downward direction.

24. The container rinsing system of claim 22 wherein the plurality of vacuum members are adapted to provide a suction force in an upward direction.

* * * * *